US010537904B2

(12) United States Patent
Lin et al.

(10) Patent No.: US 10,537,904 B2
(45) Date of Patent: Jan. 21, 2020

(54) HAND-HELD SHOWERHEAD MOUNTING BRACKET

(71) Applicant: FUJIAN XIHE SANITARY WARE TECHNOLOGY CO., LTD., Nan'An (CN)

(72) Inventors: Xiaofa Lin, Nan'An (CN); Xiaoshan Lin, Nan'An (CN); Caibo Gu, Nan'An (CN); Qiqiao Liu, Nan'An (CN); Xiaoqing Deng, Nan'An (CN)

(73) Assignee: Fujian Xihe Sanitary Ware Technology Co., Ltd., Nan'An (CN)

( * ) Notice: Subject to any disclaimer, the term of this patent is extended or adjusted under 35 U.S.C. 154(b) by 150 days.

(21) Appl. No.: 15/867,997

(22) Filed: Jan. 11, 2018

(65) Prior Publication Data

US 2018/0339300 A1 Nov. 29, 2018

(30) Foreign Application Priority Data

May 27, 2017 (CN) ..... 2017 2 0615067 U

(51) Int. Cl.

| | |
|---|---|
| ***B05B 1/18*** | (2006.01) |
| ***E03C 1/06*** | (2006.01) |
| ***B05B 15/62*** | (2018.01) |
| ***B05B 9/01*** | (2006.01) |
| ***B05B 15/65*** | (2018.01) |

(52) U.S. Cl.

CPC ..... *B05B 1/185* (2013.01); *B05B 9/01* (2013.01); *B05B 15/62* (2018.02); *B05B 15/65* (2018.02); *E03C 1/06* (2013.01); *B05B 1/18* (2013.01)

(58) Field of Classification Search

CPC ..... B05B 1/185; B05B 15/62; B05B 15/65; B05B 1/18; B05B 9/01; E03C 1/06

USPC ..... 239/282, 283, 525, 530, 587.1, 587.4, 239/588, 600; 248/75, 79; 4/596, 605, 4/615

See application file for complete search history.

(56) References Cited

U.S. PATENT DOCUMENTS

| | | | | | |
|---|---|---|---|---|---|
| 3,837,013 | A * | 9/1974 | Davis | A47K 5/02 | 248/75 |
| 3,865,310 | A * | 2/1975 | Elkins | E03C 1/06 | 239/283 |
| 3,979,096 | A * | 9/1976 | Zieger | E03C 1/06 | 248/75 |
| 4,719,654 | A * | 1/1988 | Blessing | E03C 1/06 | 4/597 |

(Continued)

*Primary Examiner* — Steven J Ganey

(74) *Attorney, Agent, or Firm* — Brooks Kushman P.C.

(57) ABSTRACT

A hand-held showerhead mounting bracket is disclosed for releasably holding a hand-held showerhead by cooperating with a hanging member located on a back side of the hand-held showerhead. The hand-held showerhead mounting bracket includes a bracket body having an entry passage for the hanging member to be inserted into the bracket body and an exit passage for the hanging member to exit the bracket body, and an assembly structure including a holding element movable between a retaining position and a release position. In the retaining position, the holding element retaining the hanging member after the hanging member is inserted into the bracket body, and in the release position, the holding element releasing the hanging member to enable the hanging member to exit the hand-held showerhead mounting bracket via the exit passage.

20 Claims, 7 Drawing Sheets

(56) References Cited

U.S. PATENT DOCUMENTS 4,964,573 A * 10/1990 Lipski ..... E03C 1/06
239/283
2013/0340854 A1* 12/2013 Quinn ..... E03C 1/0412
137/343

* cited by examiner

HAND-HELD SHOWERHEAD MOUNTING BRACKET

CROSS-REFERENCE TO RELATED APPLICATIONS

This application claims foreign priority benefits under 35 U.S.C. § 119(a)-(d) to Chinese Patent Application No. 201720615067.5, filed on May 27, 2017, the entire specification of which is hereby incorporated by reference in its entirety for all purposes.

TECHNICAL FIELD

This application relates to sanitary industry, and in particular, to a hand-held showerhead mounting bracket.

BACKGROUND

At present, the way of fixing the hand-held showerhead is achieved by a separate fixed bracket into which a hose connector of the hand-held showerhead connected to a hose is plugged downwards. Although the above way is simple, the user experience is still not user-friendly enough, and it is very inconvenience especially for users such as the elderly and children in use. To be specific, the hand-held showerhead is originally arranged in a very high fixed bracket, and when the hand-held showerhead is taken off, since it is connected to the fixed bracket at the hose connector, i.e. the plug-in position is at the hose connector which is loose and cannot serve as a force application point, the height of the position where the hand-held showerhead is held must exceed the plug-in position, and then the showerhead can only be taken off from the fixed bracket by lifting the handle of the showerhead up. The whole taking-off process is not user-friendly enough and it is inconvenient in use. Especially in Europe and America, when a hand-held showerhead is plugged into the fixed bracket, the existing method is also used for assembling, the position for fixing the showerhead is arranged below the hand-held showerhead, and both fixing and taking the showerhead can be achieved when the positions of the user's hand exceed the fixed position (plug-in position), so the user experience is insufficient and still needs to be further improved.

SUMMARY

The embodiments of the present disclosure provide a hand-held showerhead mounting bracket which is simple in structure, reasonable in design and can be implemented easily, and the assembling structure used in the mounting bracket enables the hand-held showerhead being easily plugged into the mounting bracket and also being easily taken off; which breaks the conventional limitation that the hand-held showerhead is taken off only after it is lifted up. A new mounting way is provided, improving the user's experience. A wall-hung showerhead formed in this way conforms to the structure and water spray form of the wall-hung showerhead, and truly achieves the function of the wall-hung showerhead In order to achieve the above object, the embodiments of the present disclosure employ the following technical scheme:

A hand-held showerhead mounting bracket for releasably holding a hand-held showerhead by cooperating with a hanging member located on a back side of the hand-held showerhead, the hand-held showerhead mounting bracket comprising:

a bracket body having an entry passage for the hanging member to be inserted into the bracket body and an exit passage for the hanging member to exit the bracket body; and an assembling structure comprising a holding element movable between a retaining position and a release position, in the retaining position, the holding element being used for retaining the hanging member after the hanging member is inserted into the bracket body, and in the release position, the holding element releasing the hanging member to enable the hanging member to exit the hand-held showerhead mounting bracket via the exit passage.

The present disclosure also provides a showerhead assembly, comprising:

a hand-held showerhead, comprising a hanging member at a back side; and a hand-held showerhead mounting bracket for releasably holding the hand-held showerhead by cooperating with the hanging member, the hand-held showerhead mounting bracket comprising:

a bracket body having an entry passage for the hanging member to be inserted into the bracket body and an exit passage for the hanging member to exit the bracket body; and an assembling structure comprising a holding element movable between a retaining position and a release position, in the retaining position, the holding element being used for retaining the hanging member after the hanging member is inserted into the bracket body, and in the release position, the holding element releasing the hanging member to enable the hanging member to exit the hand-held showerhead mounting bracket via the exit passage.

The present disclosure further provides a method of using the showerhead assembly, comprising:

detaching the hand-held showerhead from the hand-held showerhead mounting bracket by moving the hand-held showerhead substantially perpendicular to a front face of the bracket body so as to move the holding element from the retaining position to the release position; and fitting the hand-held showerhead into the hand-held showerhead mounting bracket by moving the hand-held showerhead substantially parallel to the front face of the bracket body.

BRIEF DESCRIPTION OF THE DRAWINGS

The drawings described herein are used to provide further understanding of the present disclosure and form a part of the present disclosure. The exemplary embodiments of the present disclosure and the description thereof are used to explain the present disclosure and do not constitute limitation thereto. In the drawings.

DETAILED DESCRIPTION

As required, detailed embodiments of the present disclosure are disclosed herein. However, it is to be understood that the disclosed embodiments are merely exemplary of the disclosure that may be embodied in various and alternative forms. The figures are not necessarily to scale. Some features may be exaggerated or minimized to show details of particular components. Therefore, specific structural and functional details disclosed herein are not to be interpreted as limiting, but merely as a representative basis for teaching one skilled in the art to variously employ the present disclosure.

In order to make the technical schemes and advantageous effects of the present disclosure clear, the present disclosure is further described herein with exemplary embodiments in combination with the exemplary drawings shown. It should be appreciated that the specific embodiments described herein are only used for explaining the present disclosure but are not used for limiting the present disclosure.

Figure 1:
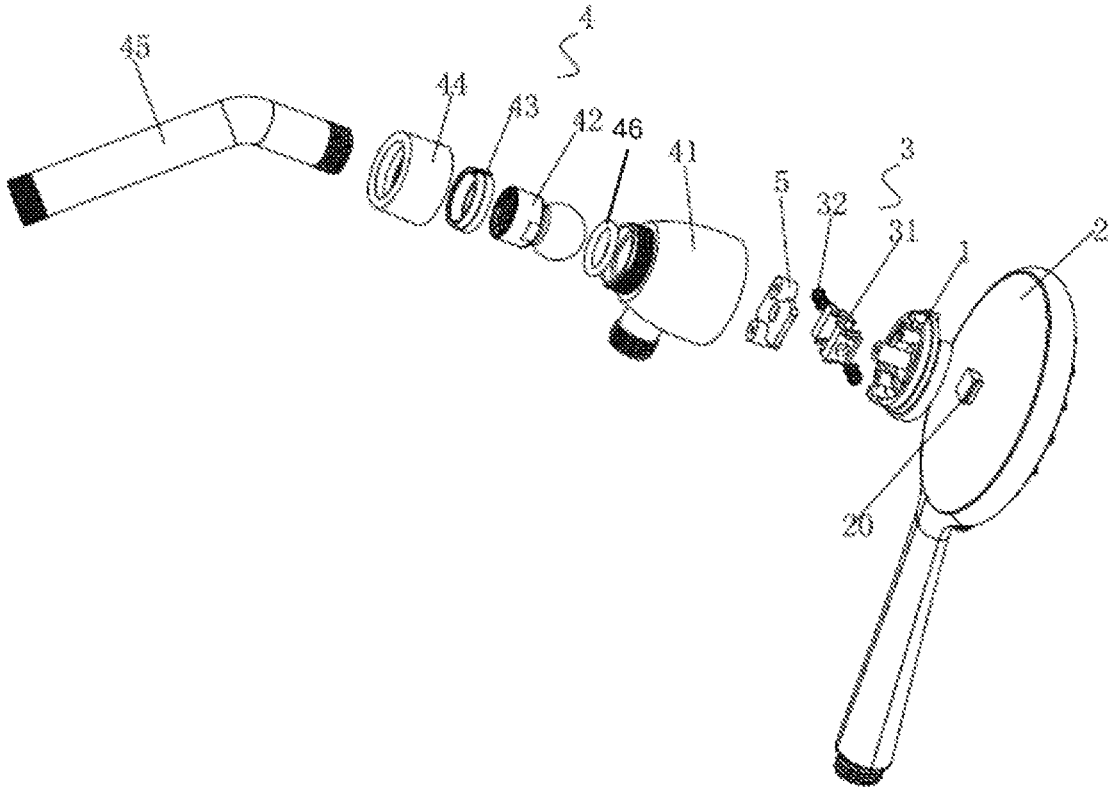
FIG. 1 is a schematic diagram of the perspective breakdown structure of a mounting bracket and a hand-held showerhead according to an embodiment of the present disclosure.
Figure 2:
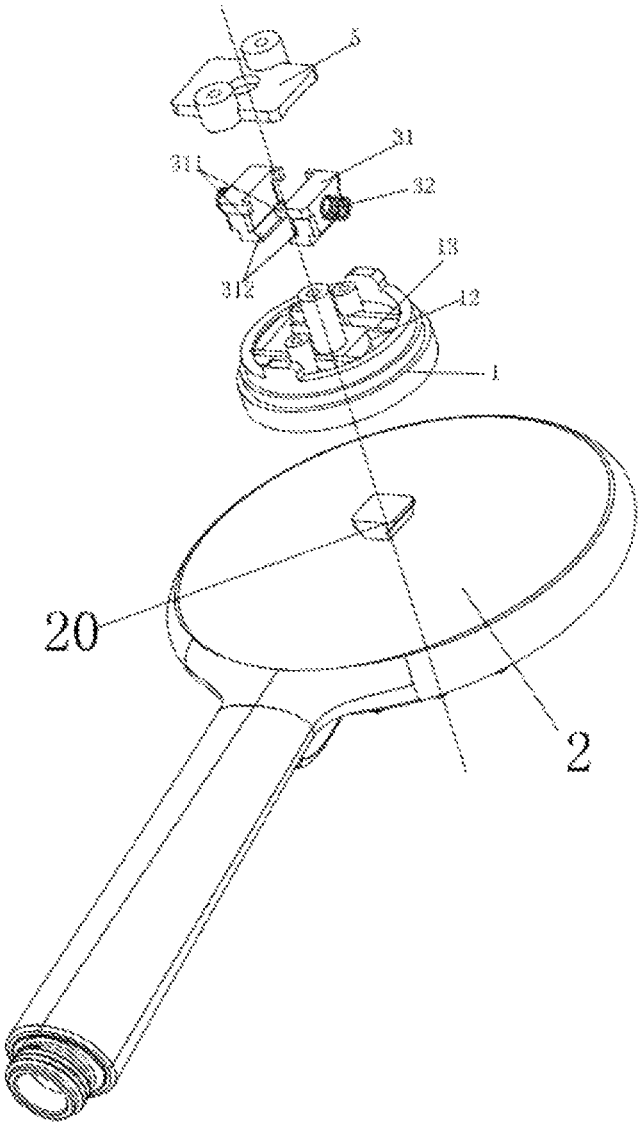
FIG. 2 is a schematic diagram of the perspective breakdown structure of the assembling structure and the showerhead according to an embodiment of the present disclosure.
Figure 3:
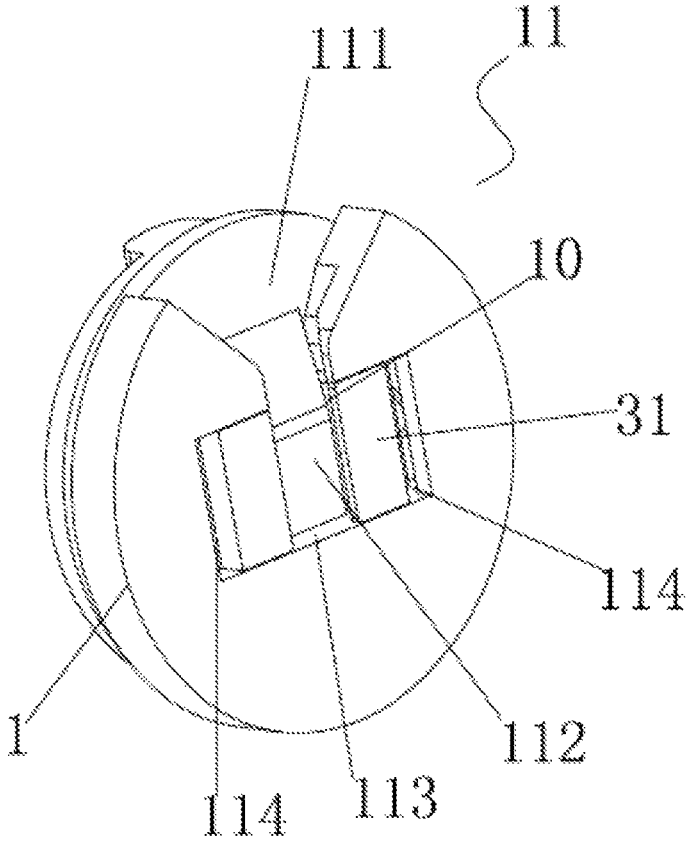
FIG. 3 is a perspective view of the state of the bracket body assembled with the assembling structure according to an embodiment of the present disclosure.
Figure 4:
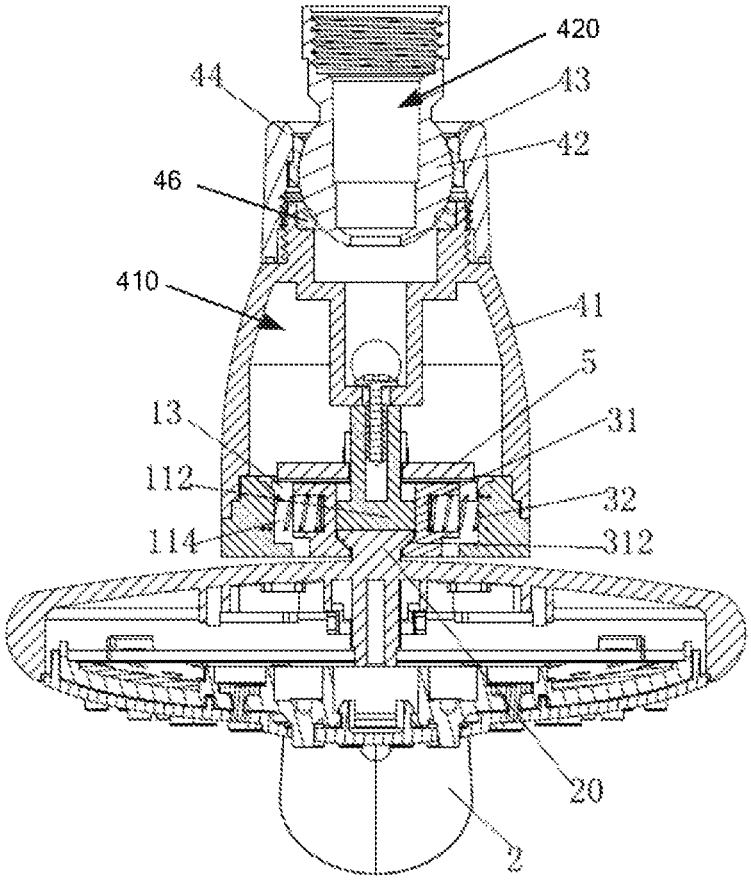
FIG. 4 is a cross-sectional view of the state of the mounting bracket assembled with the hand-held showerhead according to an embodiment of the present disclosure.
Figure 5:
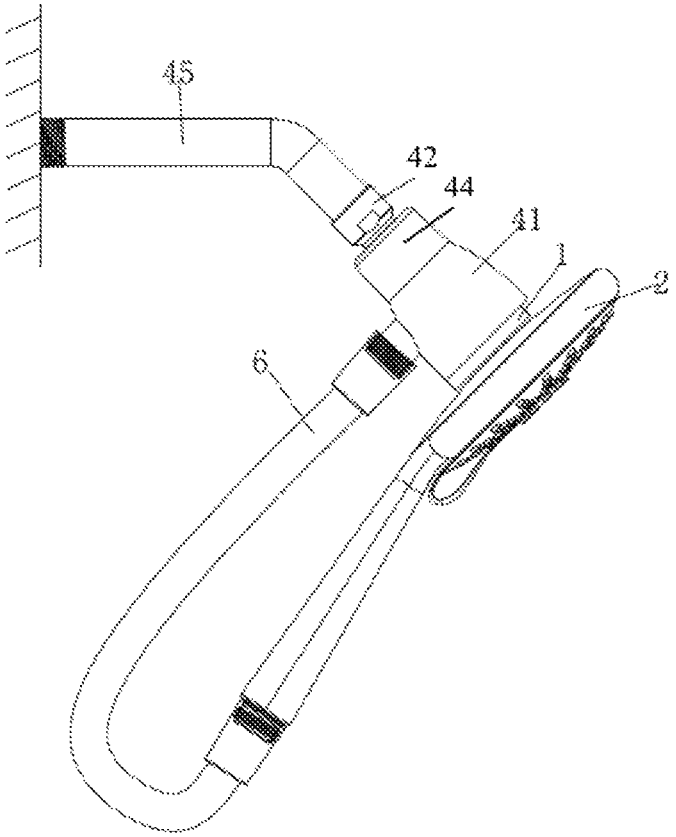
FIG. 5 is a side view of the state of the mounting bracket assembled with the hand-held showerhead according to an embodiment of the present disclosure.
Figure 6:
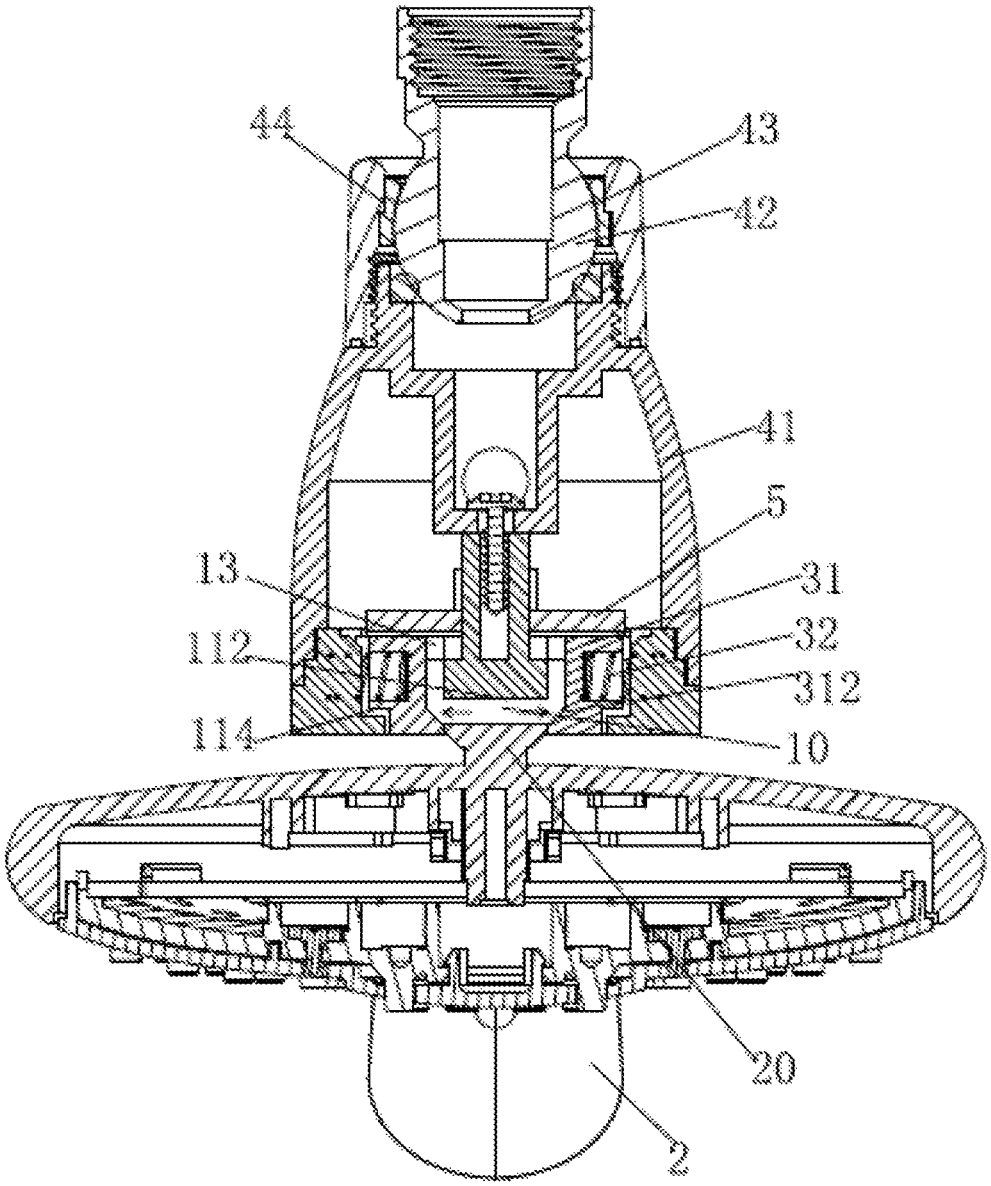
FIG. 6 is a cross-sectional view of the state of the mounting bracket about to be separated from the hand-held showerhead according to an embodiment of the present disclosure.
Figure 7:
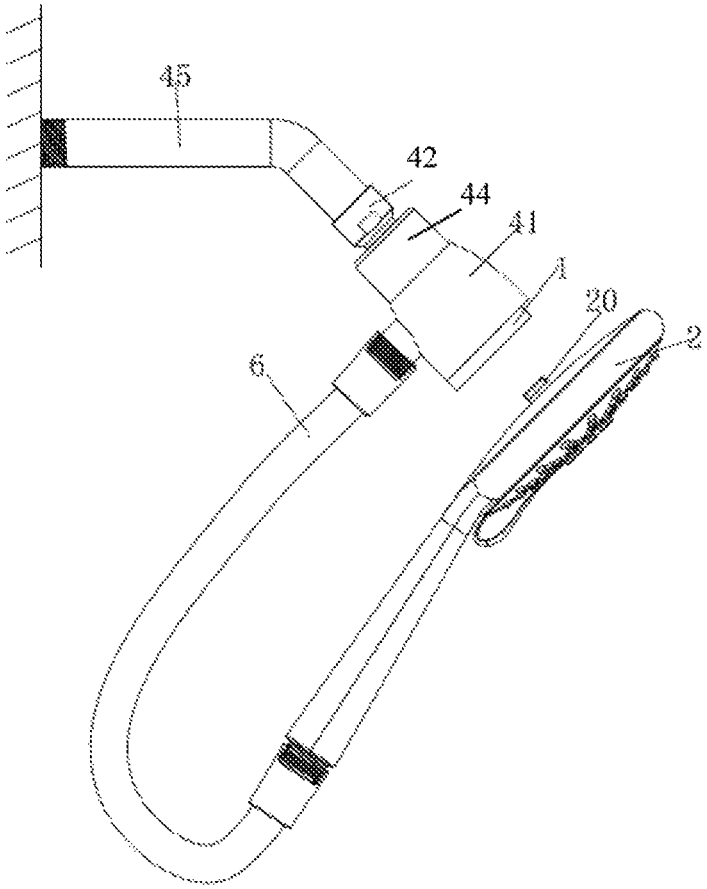
FIG. 7 is a side view of the state of the mounting bracket separated from the hand-held showerhead according to the embodiment of the present disclosure.

FIGS. 1 to 7 exemplarily show a hand-held showerhead mounting bracket according to various embodiments of the present disclosure, including a bracket body 1 onto which a hand-held showerhead 2 may be installed to form a wall-hung showerhead. The back side of the hand-held showerhead 2 is provided with a hanging member 20 which is screwed or integrally formed on the back side of the hand-held showerhead 2. On the bracket body 1 are formed an entry passage for the hanging member 20 to be inserted into the bracket body 1 and an exit passage for the hanging member 20 to exit the bracket body 1. Optionally, the entry passage and the exit passage are the same passage. Optionally, the entry passage and the exit passage are different passages. Optionally, the entry passage and the exit passage partially overlap.

Advantageously, for example, in the illustrated embodiment, a passage throughout the front face of the bracket body 1 is formed on the bracket body 1, and the passage is used for the exit passage to allow the hanging member 20 of the hand-held showerhead 2 to detach from the bracket body 1 in a direction substantially perpendicular to the front face of the bracket body 1. Optionally, the passage is used for the entry passage to allow the hanging member 20 of the hand-held showerhead 2 to enter the bracket body 1 in a direction substantially perpendicular to the front face of the bracket body 1.

Advantageously, for example, in the illustrated embodiment, a passage from a side of the bracket body 1 toward the middle of the bracket body 1 is formed on the bracket body 1, and the passage is used for an entry passage to allow the hanging member 20 of the hand-held showerhead 2 to enter the bracket body 1 in a direction substantially parallel to the front face of the bracket body 1. According to the illustrated embodiment, this passage is a T-shaped groove 11. As shown in the figure, the T-shaped groove 11 is adapted to operate in cooperation with the corresponding T-shaped hanging member 20. Optionally, this passage is used for the exit passage to allow the hanging member 20 of the hand-held showerhead 2 to exit the bracket body 1 in a direction substantially parallel to the front face of the bracket body 1.

The hand-held showerhead mounting bracket also includes an assembling structure 3 for hanging the hand-held showerhead 2 to the bracket body 1.

The assembling structure 3 comprises a holding element 31 movable between a retaining position and a release position, and in the retaining position, the holding element 31 is used for retaining the hanging member 20 of the hand-held showerhead 2 after the hanging member 20 is inserted into the bracket body 1, and in the release position, the holding element 31 releases the hanging member 20 so that the user can take the hand-held showerhead off. According to various embodiments of the present disclosure, the holding element 31 is used for retaining the hanging member 20 by at least partially closing the exit passage, and enabling the hanging member 20 to exit the bracket body 1 by opening the exit passage. According to various embodiments of the present disclosure, the holding element 31 is used for retaining the hanging member 20 by a frictional force between the holding element 31 and the hanging member 20, and enabling the hanging member 20 to exit the bracket body 1 by removing that frictional force. The holding element 31 may be moved from the hold position to the release position by the user's action of taking the hand-held showerhead off.

The assembling structure 3 may further include an elastic element 32 for biasing the holding element 31, so as to reset the holding element 31 after the hanging member 20 of the hand-held showerhead 2 exits the bracket body 1 (i.e., returning from the release position to the hold position). Optionally, the elastic element is also used for biasing the holding element 31 so as to apply the pressure to the hanging member 20 to retain the hanging member 20 after the hanging member 20 of the hand-held showerhead 2 enters the bracket body 1.

When the user hangs the hand-held showerhead, the hanging member 20 enters the bracket body 1 via the entry passage, and is positioned to form a hanging fitting with the holding element 31 located in the retaining position and/or the bracket body 1. When the user separates the hand-held showerhead, the holding element 31 is placed in the release position, to allow the hand-held showerhead 2 to exit the bracket body 1 via the exit passage. After the hanging member 20 is detached, the elastic element 32 returns the holding element 31 to the retaining position thereof.

According to a further embodiment, the holding element itself is elastic. In this case, no special elastic members are needed.

According to the illustrated embodiment, the holding element 31 consists of two holding blocks 31. The two holding blocks 31 are slideably installed in the bracket body 1 and arranged oppositely and define a shutter holding channel 10 that is aligned with the entry passage (T-shaped groove 11) of the hanging member in the bracket body 1. When the hand-held showerhead 2 is installed in the bracket body 1 to form a wall-hung showerhead, the hanging member 20 of the hand-held showerhead 2 is positioned in the shutter holding channel 10. The holding block 31 may include a blocking portion 312, and the blocking portions 312 of the two holding blocks may be arranged oppositely. When the holding blocks 31 are in the retaining position, the blocking portions 312 of two holding blocks 31 cooperate to form a shutter blocking configuration, so as to at least partially enclose the exit passage of the hanging member 20. When the hanging member 20 is inserted into the shutter holding channel 10 between the two holding blocks 31, the shutter blocking configuration can block and limit the hanging member 20, and the hand-held showerhead 2 can be firmly limited in the shutter holding channel 10 by the blocking of the blocking portion 312 when being hung for use, and will not be detached from the shutter holding channel 10 due to the self-weight of the hand-held showerhead 2 and the guiding force generated when water flows out. A slope surface which cooperates with the hanging member 20 may be formed on the blocking portion 312, facilitating smoothly push the holding element 31 from the retaining position to the release position by the user's action of taking the hand-held showerhead off.

It should be understood that other types of holding elements can be envisaged.

According to the illustrated embodiment, the elastic element 32 consists of two springs 32. The two springs 32 are arranged with respect to the two holding blocks 31, and two ends of each spring 32 act between the holding blocks 31 and the bracket body 1.

It should be understood that other types of elastic elements can be envisaged.

The illustrated embodiment is used as an example below to illustrate how to use the mounting bracket for hand-held showerhead according to the present disclosure. When the user hangs the hand-held showerhead 2, the hanging member 20 is inserted into the shutter holding channel 10 combined by two holding blocks 31 through the T-shaped groove 11 of the bracket body 1 to form a hanging fitting. When the user separates the hand-held showerhead 2, the hand-held showerhead 2 is pulled so that the hanging member 20 thereon is pushed against the two holding blocks 31. The two holding blocks 31 are moved toward both sides and away from each other after being applied a force, and compress the springs 32, so as to detach the hanging member 20 of the hand-held showerhead 2 from the shutter holding channel 10, and from the mounting bracket through the opening in the front face of the bracket body 1.

According to an exemplary embodiment of the present disclosure, the bracket body 1 includes a guide portion 111. The guide portion 111 is configured to guide the hanging member 20 into the bracket body 1 (the shutter holding channel 10) via the entry passage. The guide portion 111 may be a V-shaped opening having an opening size larger than the width of the hanging member 20, so that the hanging member 20 can be easily guided into the mounting bracket and fixed by the guide portion 111, without the need of precise positioning when the hanging member is hung.

According to an exemplary embodiment of the present disclosure, the bracket body 1 includes a supporting portion 112. The supporting portion 112 is configured to support the hanging member 20 at a side opposite the showerhead (a back side) so as to limit, together with the holding blocks 31, the displacement of the hanging member 20 in a direction perpendicular to the front face of the bracket body 1 after the showerhead is hung.

According to an exemplary embodiment of the present disclosure, the bracket body 1 includes a limiting portion 113. The limiting portion 113 is arranged perpendicular to the supporting portion 112, so as to limit, together with the holding blocks 31, the displacement of the hanging member 20 in a direction parallel to the front face of the bracket body 1 after the showerhead is hung. Optionally, the limiting portion 113 may be used for limiting the displacement of the holding blocks 31 in a direction parallel to the front face of the bracket body 1. Taking the illustrated embodiment as an example, the hanging member 20 can be firmly hung into the bracket body 1 (the shutter holding channel 10), under the combined action of the back support of the hanging member 20 on the support portion 112, the left and right limits and front limit of the two holding blocks 31 and the lateral support of the limiting portion 113.

According to an exemplary embodiment of the present disclosure, the bracket body 1 includes two accommodating portions 114. The two accommodating portions 114 are arranged on two sides of the supporting portion 112, respectively, and provide a space for slide displacement of the two holding blocks 31. Through slots 12 for receiving the two holding blocks 31 are provided in the back side of the bracket body 1 and corresponding to the accommodating portion 114, and lateral slides 13 are formed on edges of the through slots 12. The two holding blocks 31 are provided with suspending shoulders 311, respectively. When the assembling structure 3 and the bracket body 1 are assembled together, the two holding blocks 31 are respectively placed into the through slots 12, and the suspending shoulders 311 slide along the lateral slides 13 so that the two holding blocks 31 relatively slideably displace. The lateral slides 13 may also be used for limiting the displacement of the holding blocks 31 in a direction perpendicular to the front face of the bracket body 1.

According to various embodiments of the present disclosure, the hand-held showerhead mounting bracket further includes an angle adjusting structure 4 for adjusting the angle of the bracket body 1 so that a universal adjustment of the mounted hand-held showerhead can be achieved, expanding the shower range. Optionally, the angle adjusting structure 4 is a ball-and-socket universal angle adjusting structure.

According to the illustrated embodiment, the angle adjusting structure 4 includes a suspending frame 41, a ball body 42, a ball socket 43 and a connecting base 44. One end of the suspending frame 41 is connected to the back side of the bracket body 1, and the other end is screwed to the connecting base 44, and they jointly form a cavity. One end of the ball body 42 fits the ball socket 43 (i.e., the ball socket 43 is mounted to cover the end of the ball body 42) and is installed in the cavity, and the other end of the ball body 42 projects out of the suspending frame 41. The ball body 42 is movable within the cavity. When the angle of the hand-held showerhead 2 hung on the mounting bracket needs to be adjusted, the hand-held showerhead 2 can be manually rotated, and the hand-held showerhead 2 drives the bracket body 1, the suspending frame 41 and the connecting base 44 to move relative to the ball body 42. When the hand-held showerhead 2 is adjusted to a proper angle, the suspending frame 41 can be fixed in that position by a frictional force between the ball body 42 and the suspending frame 41, thereby enabling the hand-held showerhead 2 to be fixed at that angle.

Optionally, the angle adjusting structure 4 further includes a friction element. The friction element is installed in the suspending frame 41, and is in contact with the ball body 42, and by means of the frictional force between the ball body 42 and the friction element, the ball body 42 is fixed relative to the suspending frame 41, so as to fix the hand-held showerhead 2 at a proper angle. In this embodiment, the friction element is an O-ring 46 which is mounted to cover the ball body 42 and is installed in the suspending frame 41.

Additionally, the O-ring 46 may also seal the gap between the ball body 42 and the suspending frame 41.

Optionally, a water route is provided in the angle adjusting structure 4. The water route has an inlet and an outlet, and a water pipe 6 is connected to the outlet and is arranged to communicate with the hand-held showerhead 2. In this embodiment, a first water route 420 is provided in the ball body 42 and a second water route 410 is provided in the suspending frame 41. Both the first water route 420 and the second water route 410 have an inlet and an outlet, the inlet of the first water route 420 may be communicated with a water supply through a pipe (e.g., a pipe located within the mounting wall), the outlet of the first water route 420 is communicated with the inlet of the second water route 410 in an watertight way (by means of a O-ring 46, preventing water-leakage), and the outlet of the second water route 410 is arranged on the suspending frame 41, the first water route 420 and the second water route 410 form a water route. The outlet of the second water route 410 is screwed to one end of the water pipe (a hose) 6 and the other end of the water pipe 6 is screwed to the hand-held showerhead 2. Screwing has a sealing effect, achieving both ends of the water pipe 6 to be connected respectively with the second water channel 410 and the hand-held showerhead 2 in a sealed manner, so as to prevent water leakage at the joint when the water passes through.

Optionally, the angle adjusting structure 4 is directly fixed to the wall, that is, the end of the connecting base 44 opposite to the suspending frame 41 is directly fixed to the wall. Optionally, in some embodiments, the mounting bracket further includes a supporting arm 45, one end of the supporting arm 45 is fixedly connected to the wall, and the other end of the supporting arm is detachably connected to the other end of the ball body 42. In the illustrated embodiment, the supporting arm 45 is screwed to the other end of the ball body 42.

In an embodiment where the supporting arm 45 is included, a third water route is provided in the supporting arm 45. The third water route has an inlet and an outlet, the inlet of the third water route can be communicated with the water supply through a pipe, and the outlet of the third water route is watertight communicated with the inlet of the first water route 420 by screwing the supporting arm 45 to the ball body 42. In this case, the first water route 420, the second water route 410 and the third water route constitute a water route.

The assembly process of the hand-held showerhead mounting bracket and the hand-held showerhead mating therewith according to the present disclosure will be described below by taking the illustrated embodiment as an example. First, the hand-held showerhead 2 is assembled by combining a showerhead body and a water output cover panel of the hand-held showerhead 2. The showerhead body is connected with water pipe 6, and the other end of the water pipe 6 is connected with the suspending frame 41, to allow water to pass through.

Next, the angle adjusting structure 4 can be assembled. The angle adjusting structure 4 not only achieves the adjustment of angle but also has water-passing function. After the ball body 42, the O-ring 46, the ball socket 43 and the connecting base 44 are assembled together, one end of the ball body 42 is installed in the suspending frame 41 by screwing the connecting base 44 to the suspending frame 41, and then, the other end of the ball body 42 is connected with the supporting arm 45 (which has a third water route for providing water supply), and finally the supporting arm 45 is connected to the wall. Water can be introduced into the second water route 410 of the suspending frame 41 via the first water route 420 of the ball body 42 after passing through the third water route of the supporting arm 45, and then sprays from the water output cover panel through the water pipe 6. The ball body 42 can rotate around the center of the ball in a predetermined range to adjust the angle between the ball body 42 and the suspending frame 41, and hence the angle of the water output cover panel of the hand-held showerhead 2 can be adjusted.

Lastly, the assembling structure 3 can be assembled. The two holding blocks 31 may be symmetrically installed in the through slots 12 of the bracket body 1, and the suspending shoulders 311 of the holding blocks 31 corresponds to the side rail 13 on the bracket body 1, and thereafter, the springs 32 are installed between the holding blocks 31 and the bracket body 1, so that one end of the spring 32 acts on the holding block 31 and the other end is arranged in an inner wall of the accommodating portion 114. When such assembly is completed, a cover body 5 is covered on the back side of the bracket body 1 to ensure that the holding blocks 31 are not easy to fall off from the side slide 13 and the through slot 12. Subsequently, the bracket body 1 may be installed on the front of the suspending frame 41.

In actual use, as shown in FIGS. 1, 2, 4, and 5, when the hand-held showerhead 2 is to be hung onto the mounting bracket, a hand holds a grip portion of the showerhead body, and correspondingly plugs the hanging member 20 arranged on the back side of the showerhead cover panel into the guiding portion 111 of the bracket body 1. The hanging member 20 is guided along the guiding portion 111 and inserted into the shutter holding channel 10, and the hanging member 20 is blocked by blocking portion 312, so that the hand-held showerhead is retained on the bracket body 1. Optionally, the hanging member 20 is inserted into the shutter holding channel 10 by pushing the holding blocks 31 toward both sides and then a held-hanging is formed. In this embodiment, the holding blocks 31 hold the hanging member 20 to the center under the acting force of the springs 32.

As shown in FIGS. 1, 2, 6, and 7, when the hand-held showerhead 2 needs to be removed from the bracket body 1 and used separately, the user may hold the grip portion of the showerhead body by hand, to pull out by directly applying a force, or by forming a lever by the showerhead body with the limiting portion 113 used as a fulcrum. At this point, the holding blocks 31 move toward both sides to overcome the acting force of the springs 32 and open the shutter holding channel 10, and the hanging member 20 on the back of the showerhead body is detached from the shutter holding channel 10 and the showerhead 2 can be easily taken off. After the hanging member 20 is taken off, the holding blocks 31 return to their original state via the springs 32, and are about to hang the hanging member 20 next time.

The present disclosure provides a hand-held showerhead mounting bracket which is simple in structure, reasonable in design and can be implemented easily, and the hand-held showerhead can be used as a wall-hung showerhead after the hand-held showerhead is hung. The assembling structure used in this mounting bracket can easily achieve that the hand-held showerhead is plugged into the mounting bracket and can also be easily taken; and for breaking the conventional limitation that the hand-held showerhead is taken off only after it is lifted up, a new plug-in mounting way is provided, in which, the showerhead can be taken off from the shutter holding channel from the front only by overcoming the acting force of the elastic elements on both sides without the need of lifting up, achieving the effects of being easily hung and taken, enhancing the user's experience. In the present disclosure the groove for hanging is arranged as a T-shape groove, and the hanging member is easily guided to be hung within the groove during entry and fits the two holding elements, and the structure is designed to be ingenious and plays good limiting and detaching effect. The T-shape groove is provided with a guiding portion, a supporting portion, a limiting portion, and an accommodating portion, first the hanging member of the hand-held showerhead is guided by the guiding portion, and then is limited by the supporting portion and the limiting portion, to ensure that the hand-held showerhead is firmly hung when being hung in the shutter holding channel, which is not easy to fall off and has good stability. The holding element of the present disclosure is installed on the back side of the bracket body, and slideably installed on the side slide. None of the suspending shoulders on the holding elements and the side slides is in contact with the hanging member in order to reduce the friction to enhance the flexibility and stability of hanging. The holding element of the present disclosure is provided with a blocking portion, and since the hanging member can be taken off from the front, the hand-held showerhead can be firmly limited when hung for use through the blocking of the blocking portion but is not easily to fall off due to the self-weight of the showerhead and the guiding force generated when water flows out. The guide portion of this disclosure guides the hanging member into the shutter holding channel smoothly, and is arranged to be V-shaped, thereby providing a greater range of guiding, so that the hanging member can be easily guided and fixed without the need of precise positioning. The present disclosure is further provided with an angle adjusting structure, enabling a universal angle adjustment of the hung hand-held showerhead, expanding the extension of the water spray. The present disclosure is further provided with a supporting arm, to increase the distance between the mounting bracket and a human body, and cooperate with the universal angle adjusting structure, to achieve three-dimensional adjustment and shower.

The above depiction has illustrated and described the preferred examples of the present disclosure. As stated above, it should be appreciated that the present disclosure is not limited to the forms described in this text, and that description should not be regarded as excluding other examples but can be used in other combinations, modifications and environments, and can be varied according to the above teaching of the present disclosure. The modifications and changes made by a person skilled in the art, without departing from the spirit and scope of the present application, should be within the protection scope of the appended claims.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. A hand-held showerhead mounting bracket for releasably holding a hand-held showerhead by cooperating with a hanging member located on a back side of the hand-held showerhead, the hand-held showerhead mounting bracket comprising:

a bracket body having an entry passage for the hanging member to be inserted into the bracket body and an exit passage for the hanging member to exit the bracket body; and an assembling structure disposed in the bracket body, the assembling structure comprising a holding element movable between a retaining position and a release position, in the retaining position, the holding element being used for retaining the hanging member after the hanging member is inserted into the bracket body via the entry passage, and in the release position, the holding element releasing the hanging member to enable the hanging member to exit the hand-held showerhead mounting bracket via the exit passage.

2. The hand-held showerhead mounting bracket of claim 1, wherein the exit passage extends perpendicular to a front face of the bracket body facing the hand-held showerhead, enabling the hand-held showerhead to be detached from the hand-held showerhead mounting bracket by moving the hand-held showerhead substantially perpendicular to the front face.

3. The hand-held showerhead mounting bracket of claim 1, wherein the entry passage extends parallel to a front face of the bracket body facing the hand-held showerhead from a side of the bracket body to a middle portion of the bracket body, enabling the hand-held showerhead to be fit into the hand-held showerhead mounting bracket by moving the hand-held showerhead substantially parallel to the front face.

4. The hand-held showerhead mounting bracket of claim 1, further comprising an elastic element for returning the holding element from the release position to the retaining position after the hanging member exits the hand-held showerhead mounting bracket.

5. The hand-held showerhead mounting bracket of claim 1, wherein the holding element is configured to retain the hanging member by at least partially closing the exit passage in the retaining position, and enable the hanging member to exit the hand-held showerhead mounting bracket by opening the exit passage in the release position.

6. The hand-held showerhead mounting bracket of claim 5, wherein the holding element comprises two holding blocks slideably installed in the bracket body, the two holding blocks being arranged oppositely and defining a shutter holding channel, the shutter holding channel being aligned with the entry passage of the bracket body, and when the hand-held showerhead is installed in the hand-held showerhead mounting bracket, the hanging member being positioned in the shutter holding channel.

7. The hand-held showerhead mounting bracket of claim 6, wherein the holding block comprises a blocking portion, and when the holding blocks are positioned in the retaining position, the blocking portions of the two holding blocks at least partially close the exit passage.

8. The hand-held showerhead mounting bracket of claim 7, further comprising an elastic element for returning the holding element from the release position to the retaining position after the hanging member exits the hand-held showerhead mounting bracket, the elastic element comprising two springs each installed between the bracket body and one of the holding blocks.

9. The hand-held showerhead mounting bracket of claim 1, wherein the entry passage is a T-shaped groove adapted to operate in cooperation with a corresponding T-shaped hanging member.

10. The hand-held showerhead mounting bracket of claim 1, wherein the bracket body comprises a guide portion configured to guide the hanging member into the entry passage.

11. The hand-held showerhead mounting bracket of claim 10, wherein the guide portion is a V-shaped opening, and the opening size of the V-shaped opening is larger than the width of the hanging member.

12. The hand-held showerhead mounting bracket of claim 1, wherein the bracket body comprises a supporting portion configured to support the hanging member at a side opposite the hand-held showerhead, to limit, together with the holding element, the displacement of the hanging member in a direction perpendicular to a front face of the bracket body after the hand-held showerhead is hung.

13. The hand-held showerhead mounting bracket of claim 12, wherein the bracket body comprises a limiting portion disposed perpendicular to the supporting portion, to limit, together with the holding element, the displacement of the hanging member in a direction parallel to the front face of the bracket body after the hand-held showerhead is hung.

14. The hand-held showerhead mounting bracket of claim 6, wherein the bracket body comprises two accommodating portions which provide a space for sliding displacement of the two holding blocks.

15. The hand-held showerhead mounting bracket of claim 1, further comprising an angle adjusting structure that is connected to a back side of the bracket body and can drive the bracket body to move so as to adjust angle of the bracket body.

16. The hand-held showerhead mounting bracket of claim 15, wherein the angle adjusting structure is a ball-and-socket universal angle adjusting structure.

17. The hand-held showerhead mounting bracket of claim 15, further comprising a supporting arm, one end of the supporting arm being fixed to a wall and the other end of the supporting arm being detachably connected to the angle adjusting structure.

18. A showerhead assembly comprising:

a hand-held showerhead, comprising a hanging member at a back side; and a hand-held showerhead mounting bracket for releasably holding the hand-held showerhead by cooperating with the hanging member, the hand-held showerhead mounting bracket comprising:

a bracket body having an entry passage for the hanging member to be inserted into the bracket body and an exit passage for the hanging member to exit the bracket body; and an assembling structure disposed in the bracket body, the assembling structure comprising a holding element movable between a retaining position and a release position, in the retaining position, the holding element being used for retaining the hanging member after the hanging member is inserted into the bracket body via the entry passage, and in the release position, the holding element releasing the hanging member to enable the hanging member to exit the hand-held showerhead mounting bracket via the exit passage.

19. The showerhead assembly of claim 18, wherein a water route is arranged in the hand-held showerhead mounting bracket, the water passage having an inlet and an outlet, the inlet being arranged to communicate with a water supply, and the outlet being connected with a water pipe that is configured to communicate with the hand-held showerhead.

20. A method of using the showerhead assembly of claim 18, comprising:

detaching the hand-held showerhead from the hand-held showerhead mounting bracket by moving the hand-held showerhead substantially perpendicular to a front face of the bracket body so as to move the holding element from the retaining position to the release position; and fitting the hand-held showerhead into the hand-held showerhead mounting bracket by moving the hand-held showerhead substantially parallel to the front face of the bracket body.

* * * * *